United States Patent [19]

Anderson

[11] 3,988,724

[45] Oct. 26, 1976

[54] THEFT ALARM

[76] Inventor: David John Anderson, 3795 Whiting Manor Lane, Glendale, Calif. 91208

[22] Filed: July 17, 1975

[21] Appl. No.: 596,675

[52] U.S. Cl. ..... 340/224; 340/276; 340/261; 340/280; 325/16; 325/355

[51] Int. Cl.[2] ..... G08B 1/08

[58] Field of Search ..... 340/224, 63, 276, 261, 340/64, 280; 325/16, 185, 186, 355, 356, 361

[56] References Cited

UNITED STATES PATENTS

| | | | |
|---|---|---|---|
| 3,618,059 | 11/1971 | Allen | 340/224 |
| 3,618,060 | 11/1971 | Nina | 340/224 |
| 3,646,515 | 2/1972 | Vodehnal | 340/64 |

*Primary Examiner*—John W. Caldwell
*Assistant Examiner*—Donnie L. Crosland
*Attorney, Agent, or Firm*—John E. Benoit

[57] ABSTRACT

A theft alarm system which includes a transmitter and a receiver which may be fastened together during non-use, with the transmitter being secured to the equipment being protected. Removal of the receiver energizes both the transmitter and receiver. Subsequent movement of the transmitter or attempts to tamper with the transmitter produces a radio frequency signal. The signal is detected in the remote receiver and produces an alarm to alert the person carrying the receiver.

11 Claims, 6 Drawing Figures

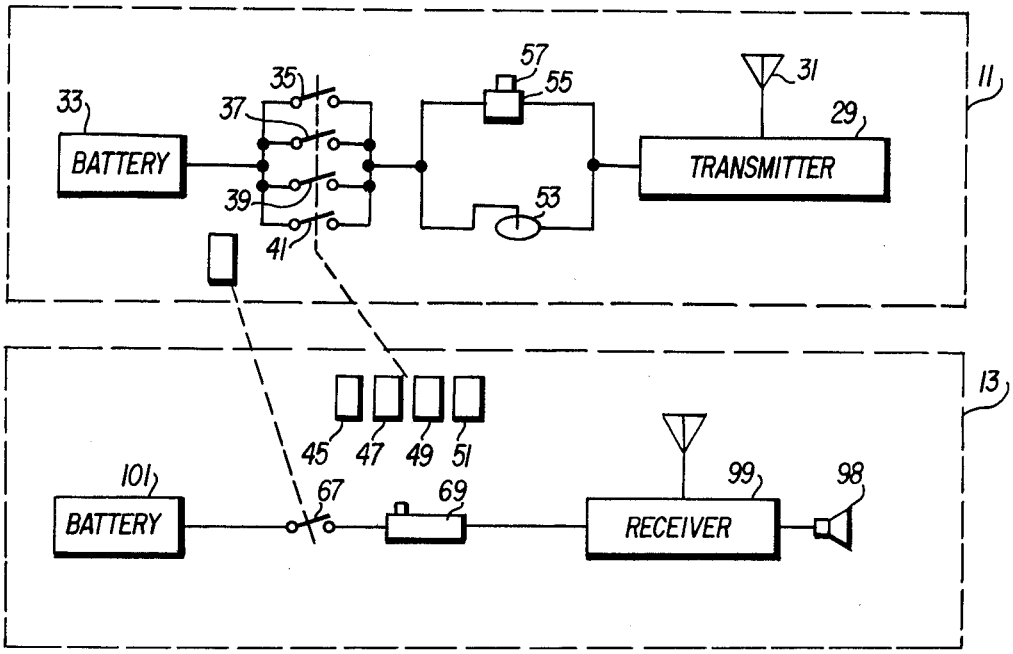
FIG. 2
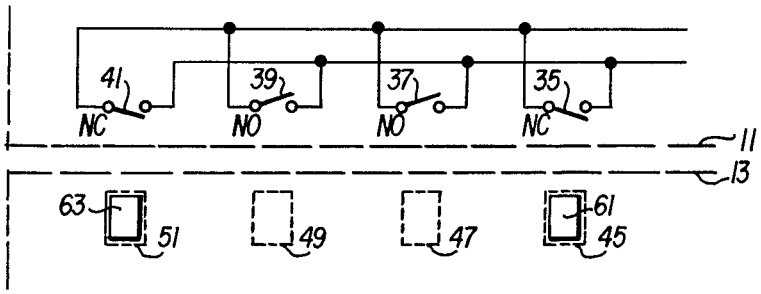
FIG. 5
FIG. 6
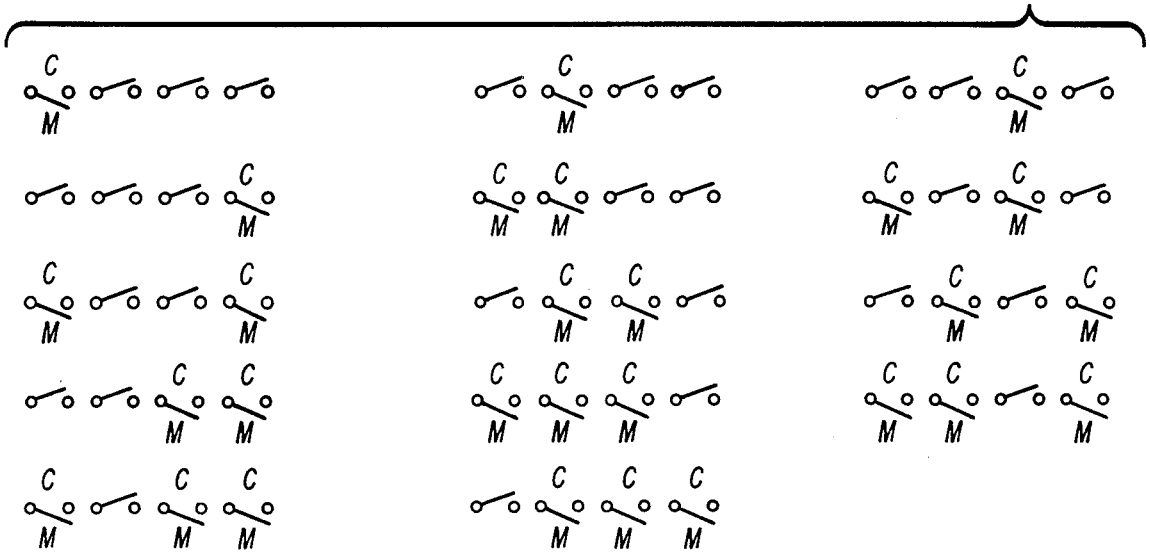

THEFT ALARM

FIELD OF THE INVENTION

This invention relates generally to a theft protection apparatus, and, more particularly, to a compact, totally portable transmitter-receiver alarm system in which the protective device including the transmitter is attached to the article to be protected, such as skis, and the alerting device including the receiver is carried by an authorized person. The apparatus is fully portable, being particularly adapted for use with skis at the skiing site.

A number of systems have been proposed which relate to the same general area as that of the present invention. Some of these systems are described in the following U.S. Pat. Nos.: 3,500,376, Cooper, , 3,618,059, Allen, 3,618,067, DeVale, 3,831,157, Wiezard, 3,831,158, Rempal et al.

All of the above relate to specific devices relating to alarm and theft protection. However, none of the above incorporate a device which includes complete portability of the entire apparatus, a tamper-proof switch, and coded arming switches. All of these features are incorporated in the present invention.

SUMMARY OF THE INVENTION

This invention provides, primarily, a means for detecting the tampering with, or theft of skis or other equipment left temporarily in a location out of sight of the owner, and otherwise unguarded. Skis left outside a half-way house on a ski slope, for example, if moved or stolen, would give the user immediate warning through the system's receiver. Both the transmitter, which is attached to the skis or equipment, and the receiver, which is retained by the user, are miniaturized so as to be completely portable without encumbering the skier.

Broadly speaking, the invention relates to a theft alarm system which includes a transmitter and a receiver which may be fastened together during non-use, with the transmitter being secured to the equipment being protected. Removal of receiver energizes both the transmitter and receiver. Subsequent movement of the transmitter or attempts to tamper with the transmitter produces a radio frequency signal. The signal is detected in the remote receiver and produces an alarm to alert the person carrying the receiver.

In the preferred embodiment disclosed herein, the transmitter unit is armed by means of coded proximity switches at the interface between the transmitter unit and the receiver unit. In addition, at least one position responsive switch and one anti-tamper switch are connected between the transmitter and a transmitter energizing means and are adapted to connect the transmitter with the energizing means when the ski is moved, or if the transmitter cover is removed from the transmitter unit. Accordingly, if the ski is moved, or if the transmitter cover is removed, an alarm signal is caused to be transmitted to the receiver unit, normally carried on the user's person.

The receiver unit has at least one proximity switch and one manual slide switch connected between the receiver and a receiver energizing means. The proximity switch connects the receiver with the energizing means whenever the receiver unit is removed from the transmitter unit. The manual slide switch may be used to disconnect the receiver from the energizing means to silence the unit after the alarm has been energized.

An object of the invention is to provide a theft warning system which is automatically actuated by movement of the skis, or equipment being protected, to transmit an alarm signal to the receiver unit, normally carried on the person of the user. The transmission of such alarm signal is to be accomplished from the protected item itself without necessarily emitting an audible alarm to the theif.

Another object of the present invention is to provide a theft protection device which is permanently attached to the ski, or equipment to be protected.

Yet another object of the present invention is to provide a theft protection device which is fully portable and extremely compact in design.

A further object and feature of this invention resides in the novel details of construction which causes an alarm signal to be transmitted when the cover of the transmitter unit is removed, without the receiver unit being in place.

A still further object of this invention is to provide an apparatus which is adaptable to any article which must be left temporarily unguarded otherwise.

These and other objects of the invention will become apparent from the following description when taken in conjunction with the drawings.

BRIEF DESCRIPTION OF THE DRAWINGS

FIG. 2 is a block diagram of the circuitry of a preferred embodiment of the present invention;

FIG. 5 is a schematic of the transmitting unit magnetic reed switch and a sample magnetic receiver configuration; and FIG. 6 is a schematic showing of the various magnet-switch combinations which may be used.

DESCRIPTION OF THE PREFERRED EMBODIMENT

While the theft protection system of the present invention will be described in conjunction with skis, it is to be noted that this is by way of illustration only and is not to be interpreted as being a limitation of the present invention. That is, the theft protection system of the present invention is adapted to be utilized to protect against the possible theft of any article which may be left unguarded temporarily.

Figure 1:
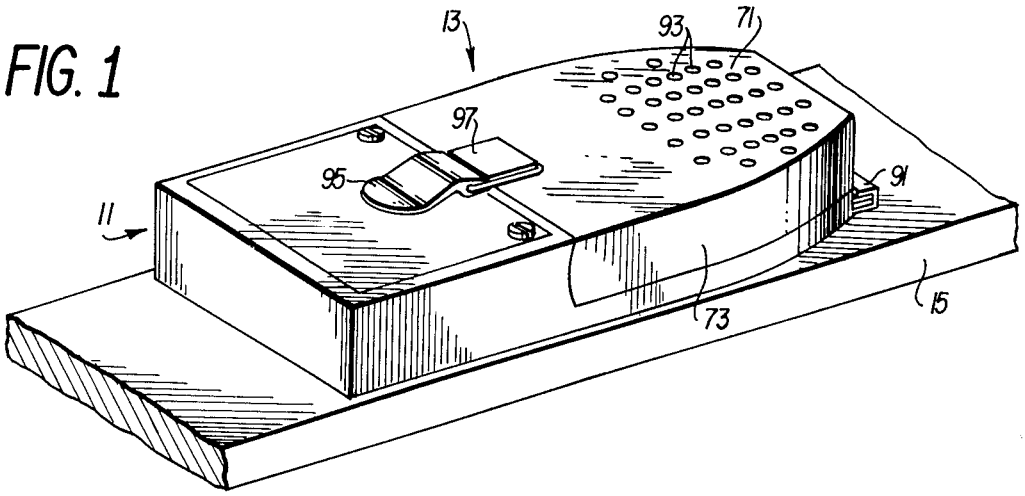
FIG. 1 is a perspective view of the transmitter-receiver of the present invention attached to a ski.

The apparatus as shown in FIG. 1 includes a transmitting device 11 and a receiving device 13. The transmitting device 11 is adapted to be secured to the article to be protected, which, in the example under consideration, comprises a set of skis 15. As noted in greater detail hereinbelow, the transmitting device 11 is operable to transmit an alarm signal to the receiver 13 when the position of the transmitting device is changed or when the transmitting device is tampered with. The receiver 13 which may be removed and located on the person of the user, is adapted to notify the user that the particular transmitting device 11 has been actuated to produce an alarm signal. Accordingly, the user may take necessary action to prevent the theft of the skis 15.

Figure 3:
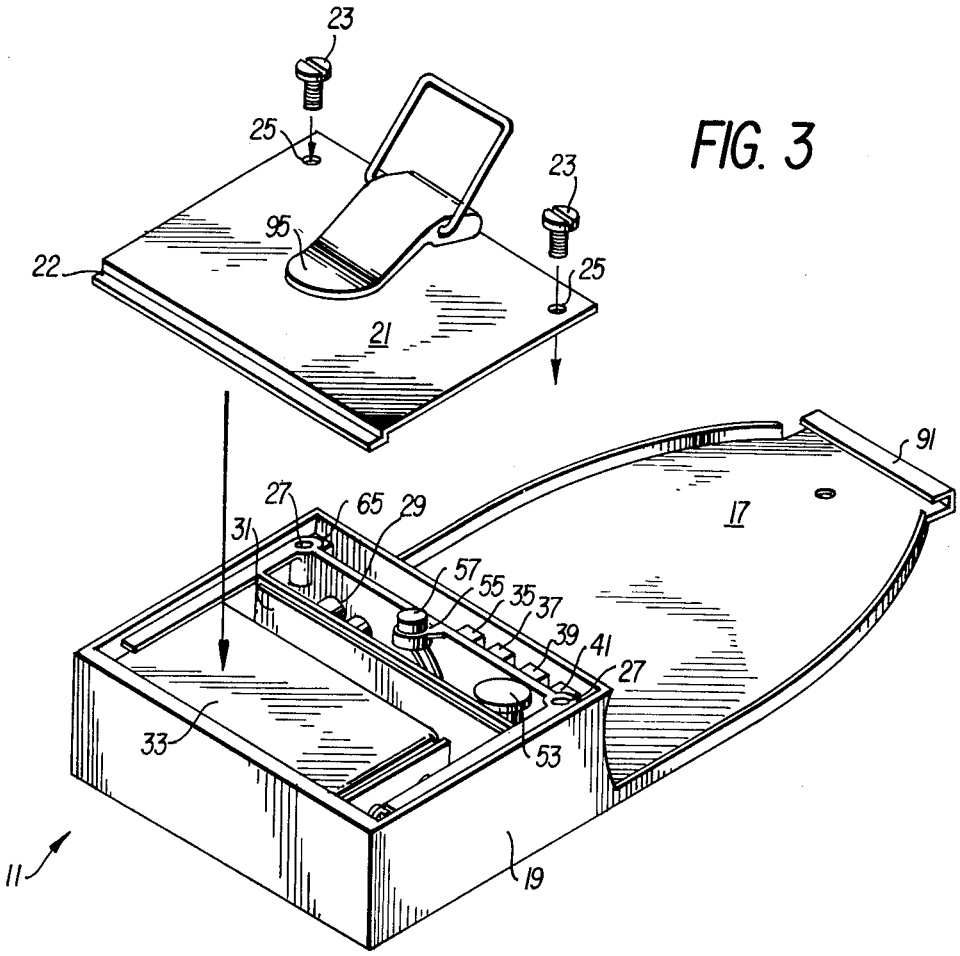
FIG. 3 is an exploded perspective view of the transmitting unit of FIG. 1.

The transmitting device 11 includes a base plate 17 as shown in FIG. 3, with a depending integral peripheral wall 19 which extend from the surface of the base plate 17 to provide a housing having an open top. A removable cover 21 closes the top opening of the housing. The cover 21 is removably fixed in place by a lip 22, and by a plurality of screws 23 or the like which pass through respective apertures 25 located in two corners of the cover 21 and which are threadably engaged in posts 27 which are integral with the wall 19.

Mounted on the upper surface of the base plate 17 inside of the housing is a transmitter 29. A transmitting antenna 31 is connected to the transmitter and is contained within the housing. The transmitter 29 is a portable transistorized transmitter which may be energized by a conventional battery 33.

Mounted on the peripheral wall 19 adjacent to the location of the receiver 13 are four reed switches 35, 37, 39, and 41. These reed switches are connected serially between the battery 33 and the transmitter 29 and in parallel with each other. These reed switches are single pole, single throw, normally open or normally closed switches which are adjacent to compartments 45, 47, 49 and 51 located in the receiver 13 of FIG. 4. Also, mounted within the housing is an omnidirectional mercury switch 53 connected serially between the battery 33 and the reed switches. Single pole, single throw, normally closed push-button switch 55 is mounted within the housing and is connected serially between the battery 33 and the reed switches 15 and connected in parallel with the mercury switch 53. The push-button switch 55 is mounted within the housing such that when the removeable cover 21 is affixed in its position and the screws 23 are fully engaged through apertures 25 into posts 27, the removeable cover 21 depresses the push-button 57 of the push-button switch 55 to move the same to the open position.

Compartments 45, 47, 49 and 51 may selectively retain permanent magnets in those desired locations adjacent switches 35, 37, 39 and 41. In the example of FIG. 5, magnets 61 and 63 are located in compartments 45 and 51 adjacent normally-closed reed switches 35 and 41.

When this particular arrangement is used, reed switches 37 and 39 are normally-open switches. Thus, when the transmitter and the receiver are locked together as shown in FIG. 1, all the switches will be open. This configuration disconnects the battery from both switch 55 and switch 53. When the receiver is removed from the transmitter, switches 35 and 41 will connect the battery to switches 53 and 55.

If some other form of magnetic configuration is placed adjacent the transmitter so as to open switches 35 and 41, it will simultaneously close one or both of the normally-open switches 37 and 39.

The use of the four compartments permits the use of multiple configurations when the device is built so that the chance of two receivers being compatible with the same transmitter is greatly reduced. Various configurations of magnets and switches are shown schematically in FIG. 6. The letter "C" denotes a normally-closed switch with those not marked being normally-open switches. The letter "M" denotes the magnets used in the particular compartments.

Also mounted within the housing on the peripheral wall 19 is a magnet 65 located so as to be adjacent a normally-closed reed switch 67 in the receiver 13 when the receiver and the transmitter are secured together. When the receiver 13 is removed from the transmitter 11, the reed switch 67 being removed from the compatibly located magnet 65, assumes its normally closed or "on" position. The manual slide switch 69 is in the "on" position at all times except to turn the alarm off after activation. Thus, when the reed switch 67 is "on", the receiver 99, is energized by the dry cell 101. The elements are schematically shown in FIG. 2.

Figure 4:
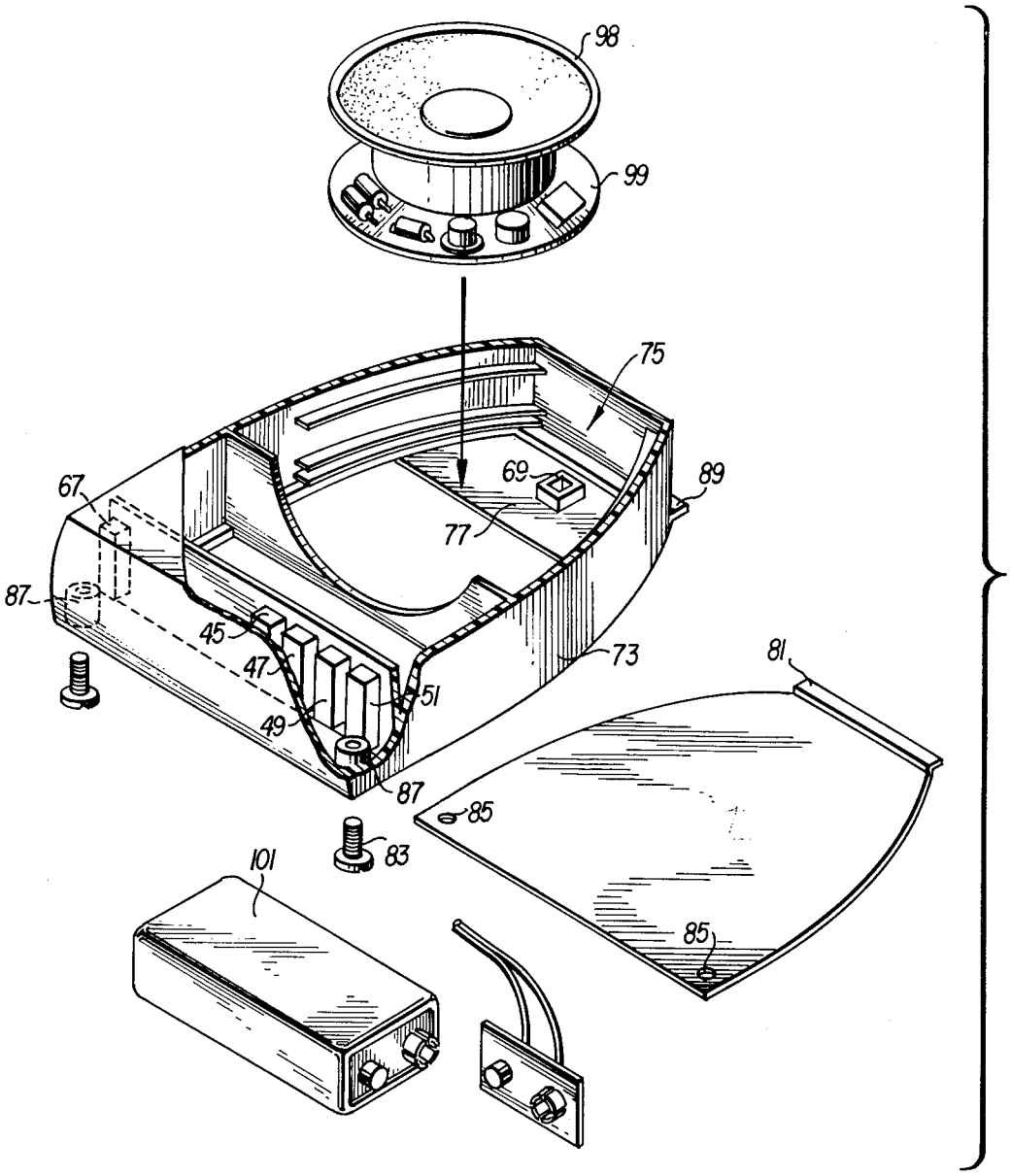
FIG. 4 is an exploded perspective view of the receiving unit of FIG. 1.

The receiving device 13 includes a top plate 71, FIG. 1, with a depending integral peripheral wall 73 which extends from the top plate 71 to define a compartment 75, FIG. 4, having an open bottom. A partial bottom wall 77 is integral with the peripheral wall 73. A removeable base 79 closes the bottom opening of compartment 75. The base 79 is removeably fixed in place by lip 81 and by a plurality of screws 83 which pass through respective apertures 85 located in two corners of the base 79 and which are threadedly engaged in posts 87 which are integral with the wall 73.

The partial bottom wall 77 extends beyond the integral peripheral wall to form a flange 89. The flange 89 is inserted in and retained by the channel 91 of the transmitter unit, FIG. 3, when the system is not in use.

The top plate 71, FIG. 1, is perforated with holes 93 to permit sound from the alarm annunciation 98, FIG. 4, to emanate to the user.

Mounted externally on the top plate 71 is a section 97 of the fastening device having the other section 95 mounted on the cover 21 of the transmitter 11. The fastening device together with the flange 89 and channel 91 provide the means for attaching the receiver to the transmitter.

Mounted within the receiver compartment 75, FIG. 4, is a radio receiver 99. The radio receiver 99 is a portable transistorized receiver which may be energized by a conventional battery 101.

Mounted on the peripheral wall 73 adjacent to the wall 19 of the transmitter housing, is a single-pole, single-throw normally closed reed switch 67. Also, mounted within the compartment 75 is a single-pole, single throw slide switch 69. The reed switch 67 and the slide switch 69 are connected serially between the battery 101 and the radio receiver 99 as indicated in FIG. 2. Reed switch 67 is held open by magnet 65 in the transmitter so long as the transmitter device and receiver are mounted together. When the receiver is removed, reed switch 67 closes.

It will be noted that reed switches 35, 37, 39 and 41 function as the on-off switches for the transmitting device 11. When the receiver 13 is removed from the apparatus, the compatibly located magnets in the receiver, being removed from the proximity of the reed switches in the transmitter device, causes one or more of the same to close, thus arming the transmitter 29. The transmitter 29 will still remain inoperative until either the mercury switch 53 or the push button switch 57 is activated to complete the circuit. The mercury switch 53 is activated whenever the ski is moved or tilted sufficiently to cause the pool of mercury to contact both terminals simultaneously. This type of switch is commercially available. The push button switch 57 is activated whenever the cover 21 of the transmitter 11 is removed.

Accordingly, if the receiver 13 is removed from the apparatus and either the mercury switch 53 or the push-button switch 57 is activated, the transmitter 29 will be energized causing an alarm signal to be transmitted. This signal is detected and amplified by radio receiver 99 which activates alarm annunciator 98.

As will be apparent, an alarm device has been provided wherein the receiver and transmitter device are secured together during non-operative periods. Removal of the receiver from the transmitter device arms both the transmitter and the radio receiver. The transmitter device remains attached to the article of concern to detect any movement thereof.

The above description and drawings are illustrative only since equivalent components could be substituted within the system without departing from the invention. Accordingly, the invention is to be limted only by the scope of the following claims.

What is claimed is:

1. A system for detecting the theft of an article comprising a transmitter housing securable to said article;

a transmitter including a battery within said transmitter housing for transmitting an alarm signal when activated;

a receiver housing including a radio receiver and battery removeably secured to said transmitter housing;

a position responsive switch means connected between said transmitter and said battery within said transmitter housing;

a magnetically activated normally-closed switch means connected between said battery within said transmitter housing and said position responsive switch means; and magnetic means in said receiver housing for maintaining said magnetically actuated switch means in an open position when said receiver housing is secured to said transmitter housing.

2. The system of claim 1 further comprising a normally closed magnetically actuated switch in said receiver housing connected between said battery in said receiver housing and said radio receiver; and magnetic means in said transmitter housing for maintaining said switch in said receiver housing in an open position when said receiver housing is secured to said transmitter housing

3. The system of claim 2 further comprising a manually operated switch connected between said switch in said receiver housing and said radio receiver.

4. The system of claim 2 further comprising an alarm connected to and actuated by said radio receiver.

5. The system for claim 1 further comprising a second normally closed switch mounted within said transmitter housing between said magnetically actuated switch and said transmitter and in parallel with said position responsive switch; and means for mounting said second switch so that it is maintained in an open position by one of the housing walls.

6. The system of claim 5 wherein said transmitter housing includes a removable cover, maintaining said second switch in an open position.

7. The system of claim 1 wherein said normally closed switch means comprising at least one magnetically actuated reed switch.

8. The system of claim 1 wherein said position responsive switch means comprises an omnidirectional mercury switch.

9. The system of claim 1 further comprising means for securing said transmitter housing to said article.

10. The system of claim 1 wherein said magnetically activated normally-closed switch means comprises a plurality of magnetic reed switches.

11. The system of claim 10 further comprising a plurality of normally-open magnetic reed switches.

* * * * *